US006382476B1

(12) United States Patent
Randall et al.

(10) Patent No.: US 6,382,476 B1
(45) Date of Patent: May 7, 2002

(54) SINGLE AXIS DUAL DISPENSING CLOSURE

(75) Inventors: Jeffrey T. Randall, Oconomowoc; Kelly A. Smith, East Troy; Susan De Groot, Pewaukee, all of WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/867,809

(22) Filed: May 30, 2001

(51) Int. Cl.[7] ..... B67D 3/00

(52) U.S. Cl. ..... 222/545; 222/482; 222/486; 222/543; 222/556; 222/565; 220/259; 215/237

(58) Field of Search ..... 222/480, 482–486, 222/545, 546, 543, 556, 565; 220/256, 259; 215/235, 237

(56) References Cited

U.S. PATENT DOCUMENTS

| | | | | | |
|---|---|---|---|---|---|
| 2,695,732 | A | | 11/1954 | Tupper | 222/189.02 |
| 2,753,051 | A | * | 7/1956 | Tupper | 215/235 |
| 3,018,024 | A | | 1/1962 | Foord | 222/498 |
| 3,187,964 | A | * | 6/1965 | Foster | 222/480 |
| 4,327,842 | A | * | 5/1982 | Walter | 215/237 |
| 4,666,068 | A | | 5/1987 | Bush | 222/546 |
| 4,717,050 | A | * | 1/1988 | Wright | 222/482 |
| 4,895,282 | A | * | 1/1990 | Robinson | 222/482 |
| 4,903,870 | A | * | 2/1990 | La Vange | 222/482 |
| 4,961,521 | A | * | 10/1990 | Eckman | 222/545 |
| 5,662,245 | A | * | 9/1997 | Grant | 222/556 |
| 5,975,368 | A | | 11/1999 | Wood | 222/151 |

* cited by examiner

*Primary Examiner*—J. Casimer Jacyna
(74) *Attorney, Agent, or Firm*—Rockey, Milnamow & Katz, Ltd.

(57) ABSTRACT

A dispensing structure is provided for a container that has an opening from which a product can be dispensed. The structure includes a body for extending around the container opening. The body defines a first dispensing aperture communicating with the container opening. An intermediate member defines at least one second dispensing aperture that is smaller than the first dispensing aperture. The intermediate member is pivotable about an axis between a closed position and an open position. A lid is pivotable on the closure body about the same axis as the intermediate member, and the lid is pivotable between a closed position and an open position.

20 Claims, 7 Drawing Sheets

SINGLE AXIS DUAL DISPENSING CLOSURE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system for dispensing product from a container. The invention is more particularly related to a system that facilitates removal of a product through either one of two different dispensing orifices.

BACKGROUND OF THE INVENTION AND TECHNICAL PROBLEMS POSED BY THE PRIOR ART

A variety of packages, including dispensing packages or containers, have been developed for particulate food products, such as herbs, spices, granular salt, etc., as well as other materials. Such containers typically have an open upper end on which is mounted a closure.

U.S. Pat. No. 5,975,368 discloses a type of dispensing closure for a dispensing container which has a body defining two relatively large side-by-side access apertures. A foraminous member defining a plurality of dispensing holes is hingedly mounted for being pivoted between (1) a first position over the two side-by-side access apertures, and (2) a second position away from the side-by-side access apertures. A lid is hinged to the body for pivoting between an open position and a closed position over the foraminous member when the foraminous member is over the side-by-side apertures in the closure body. In the closed position, the lid sealingly occludes the plurality of apertures in the foraminous member. When the lid is open, the foraminous member can be moved to either of two selected positions: (1) a full open position spaced away from the two side-by-side apertures in the closure body to permit access to the product through the two side-by-side apertures in the closure body, and (2) a closed position wherein the foraminous member is disposed over the two side-by-side apertures in the closure body to permit sprinkling of the container contents through the foraminous member apertures.

While the above-described container closure functions well when used in the applications for which it has been designed, it would be desirable to provide an improved dispensing system for containers providing certain operational advantages and accommodating certain design variations.

It would be particularly desirable to provide an improved dispensing structure have a body with a first dispensing aperture, a lid, and an intermediate member, wherein the intermediate member defines at least one smaller dispensing aperture and can be readily rotated together with a lid between open and closed positions so as to eliminate the need to separately rotate the lid and separately rotate the intermediate member.

It would also be advantageous if such an improved dispensing structure could be provided with an intermediate member and lid which can fit more closely together in the open position so as to present a more unified configuration in the open position that provides clear access to a larger dispensing aperture in the closure body.

It would also be beneficial if such an improved dispensing structure could accommodate the use of a molded, one-piece hinge connecting the closure body and intermediate member or connecting the intermediate member and the lid.

Further, it would be desirable if such an improved dispensing structure could accommodate a sealing lid system which would function to preserve the freshness of the product in the container when the dispensing structure is in a closed condition.

It would also be beneficial if such an improved dispensing structure could accommodate the use of a variety of different materials.

Further, it would be desirable if such an improved dispensing structure could be provided with a design that would accommodate efficient, high-quality, large volume manufacturing techniques with a reduced product reject rate.

The present invention provides an improved dispensing structure which can accommodate designs having the above-discussed benefits and features.

SUMMARY OF THE INVENTION

According to one aspect of the present invention, a dispensing system or structure is provided for a container that has an opening to the container interior. The dispensing structure includes a body for extending around the container opening. The body defines a first dispensing aperture communicating with the container opening.

The dispensing structure further includes an intermediate member which defines at least one second dispensing aperture that is smaller than the first dispensing aperture. The intermediate member is pivotable about an axis between (1) a closed position sealingly engaged with the body to locate the second dispensing aperture over the first dispensing aperture and block a peripheral portion of the first dispensing aperture which extends peripherally beyond the second dispensing aperture, and (2) an open position away from the closed position to permit complete access to the first dispensing aperture.

A lid is pivotable about the axis between (1) a lid closed position over the second dispensing aperture for sealingly engaging the intermediate member when the intermediate member is in its closed position whereby the second dispensing aperture is sealingly occluded, and (2) an open position away from the lid closed position to permit access to the second dispensing aperture when the intermediate member is in the closed position.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENT

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the dispensing structure of this invention is described in the normal (upright) operating position, and terms such as upper, lower, horizontal, etc., are used with reference to this position. It will be understood, however, that the dispensing structure of this invention may be manufactured, stored, transported, used, and sold in an orientation other than the position described.

Figure 1:
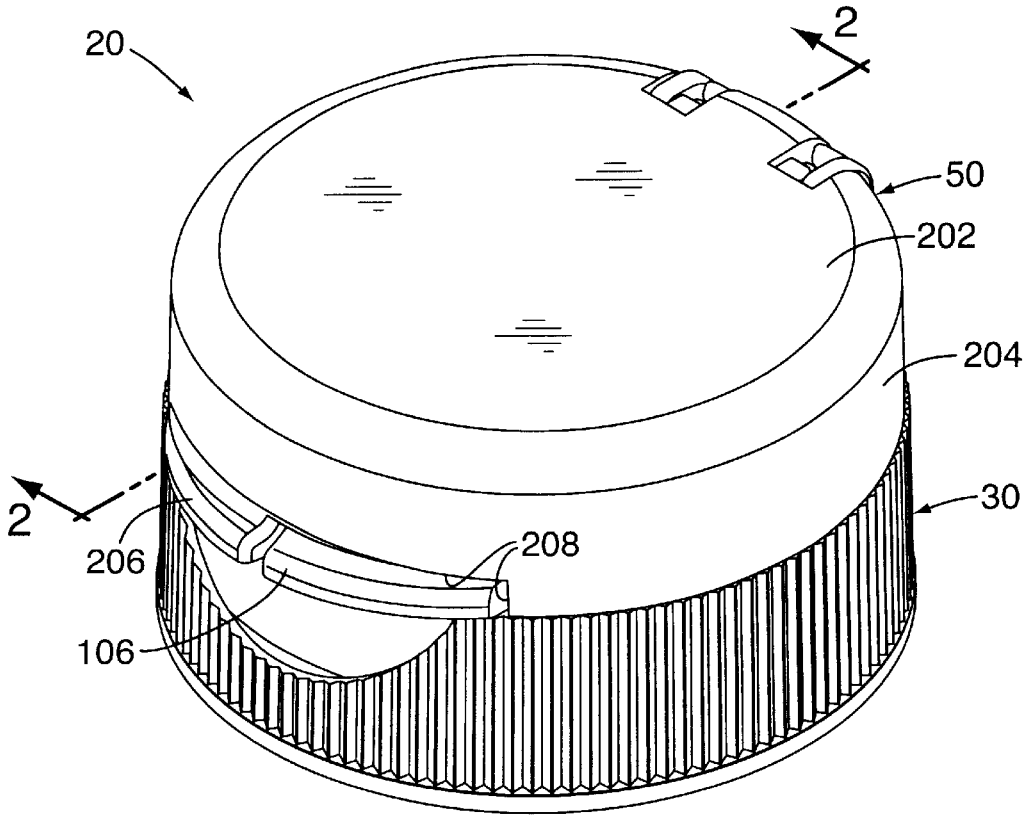
FIG. 1 is a perspective view of a preferred embodiment of a dispensing structure of the present invention in the form of a closure which can be removably mounted on a container (not shown)

A presently preferred embodiment of a dispensing structure or system of the present invention is illustrated in FIGS. 1–9 and is designated generally therein by reference number 20 in FIG. 1. In the preferred embodiment illustrated, the dispensing structure 20 is provided in the form of a closure 20 which is adapted to be mounted on a container (not shown). The body of the container may have a suitable configuration with an upwardly projecting neck which may have a different cross-sectional shape than the container body.

The container would typically contain a liquid material, pasty material, powdered material, granular material, or other particulate material. The container may have a rigid wall or walls or may have a somewhat flexible wall or walls. The container defines an opening, typically at the upper end of the container neck (if the container has such a neck).

Although the container, per se, need not necessarily form a part of the present invention, per se, it will be appreciated that the dispensing structure or system of the present invention may be provided as a unitary portion, or extension, of the top of the container. However, in the preferred embodiment illustrated, the dispensing structure 20 is a separate element (i.e., a closure) which is adapted to be mounted to a previously manufactured container which has an opening to the container interior.

Figure 4:
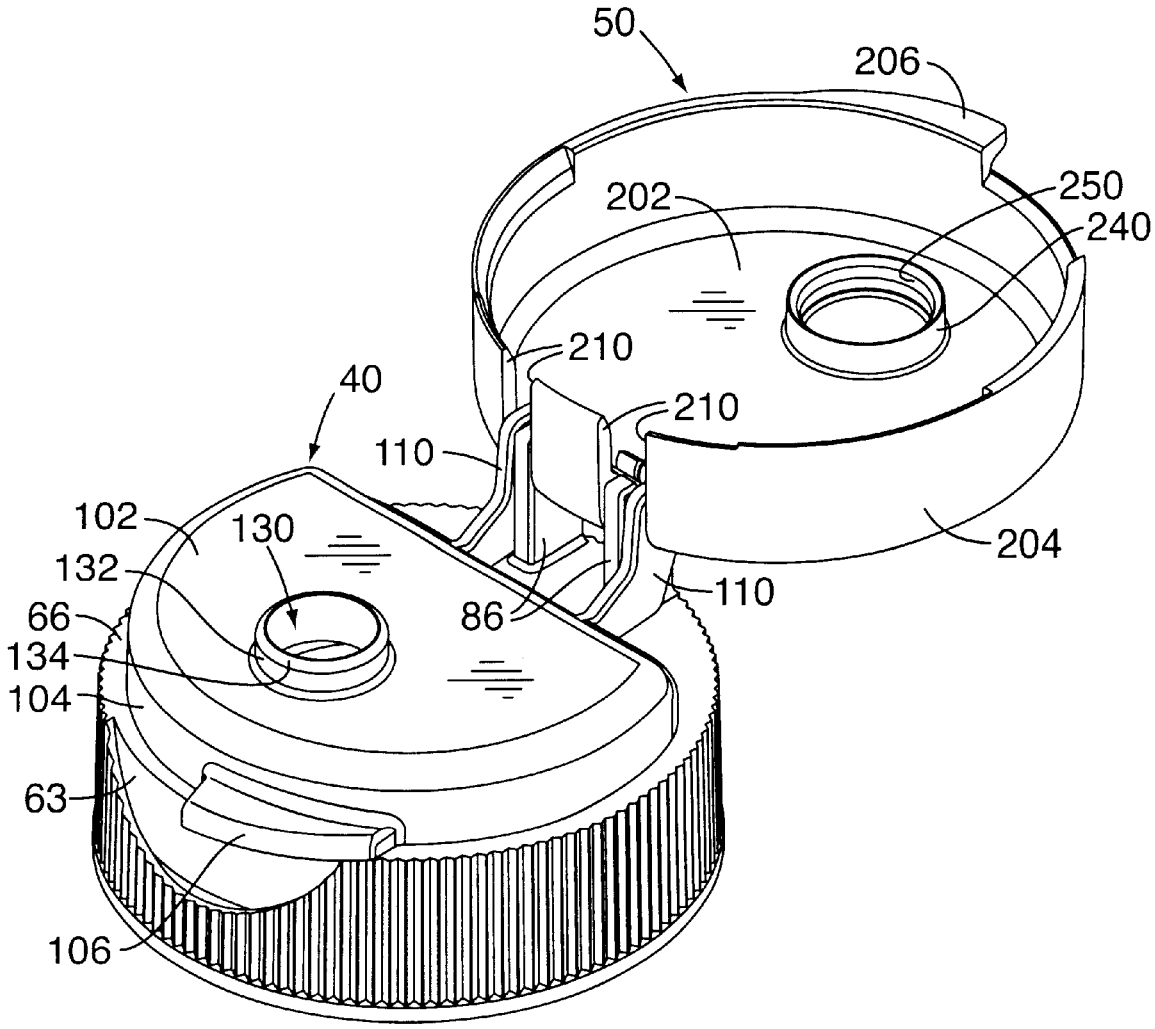
FIG. 4 is a view similar to FIG. 1, but FIG. 4 shows the lid of the closure in an open orientation.
Figure 5:
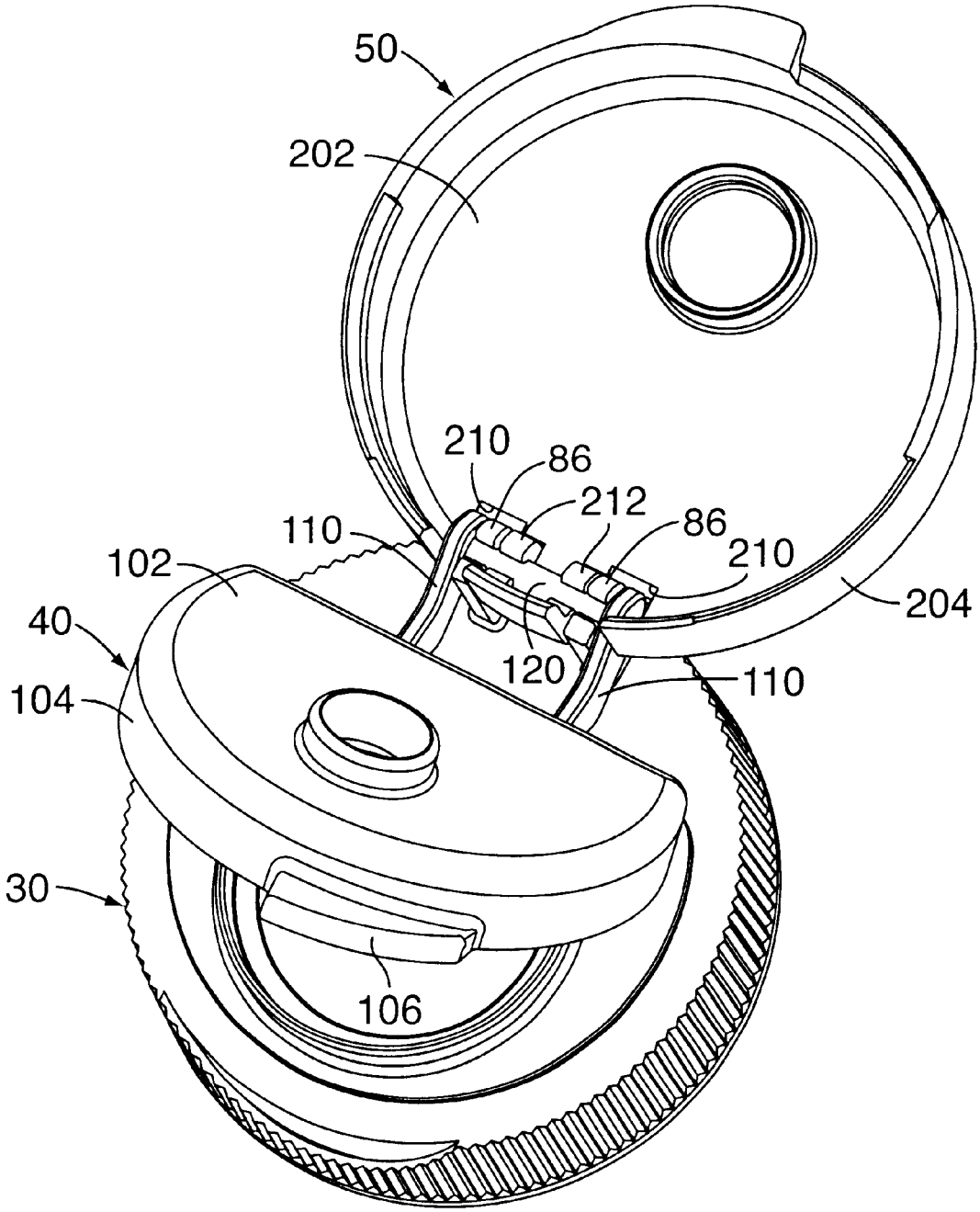
FIG. 5 is a view similar to FIG. 4, but FIG. 5 shows the intermediate member partially lifted away from the body.

As shown in FIG. 5, the preferred embodiment closure or dispensing structure 20 of the present invention includes a base portion or body 30, an intermediate member 40, and a lid 50. The intermediate member 40, lid 50, and body 30 are hingedly connected by means described in detail hereinafter. This accommodates movement of the lid 50 from a closed position (FIG. 1) to an open position (FIG. 4) while maintaining the lid 50 attached to the body 30, and this also permits movement of the intermediate member 40 from a closed position (FIG. 4) to an open position (FIG. 7) while maintaining connection of the lid 50, intermediate member 40, and body 30.

Figure 2:
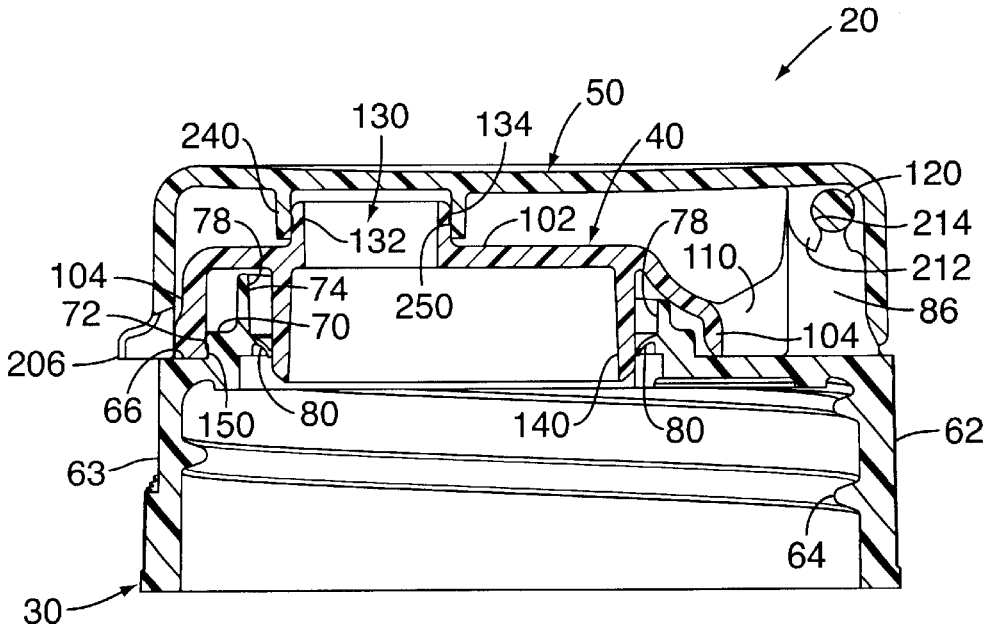
FIG. 2 is an enlarged, cross-sectional view taken generally along the plane 2—2 in FIG. 1.
Figure 3:
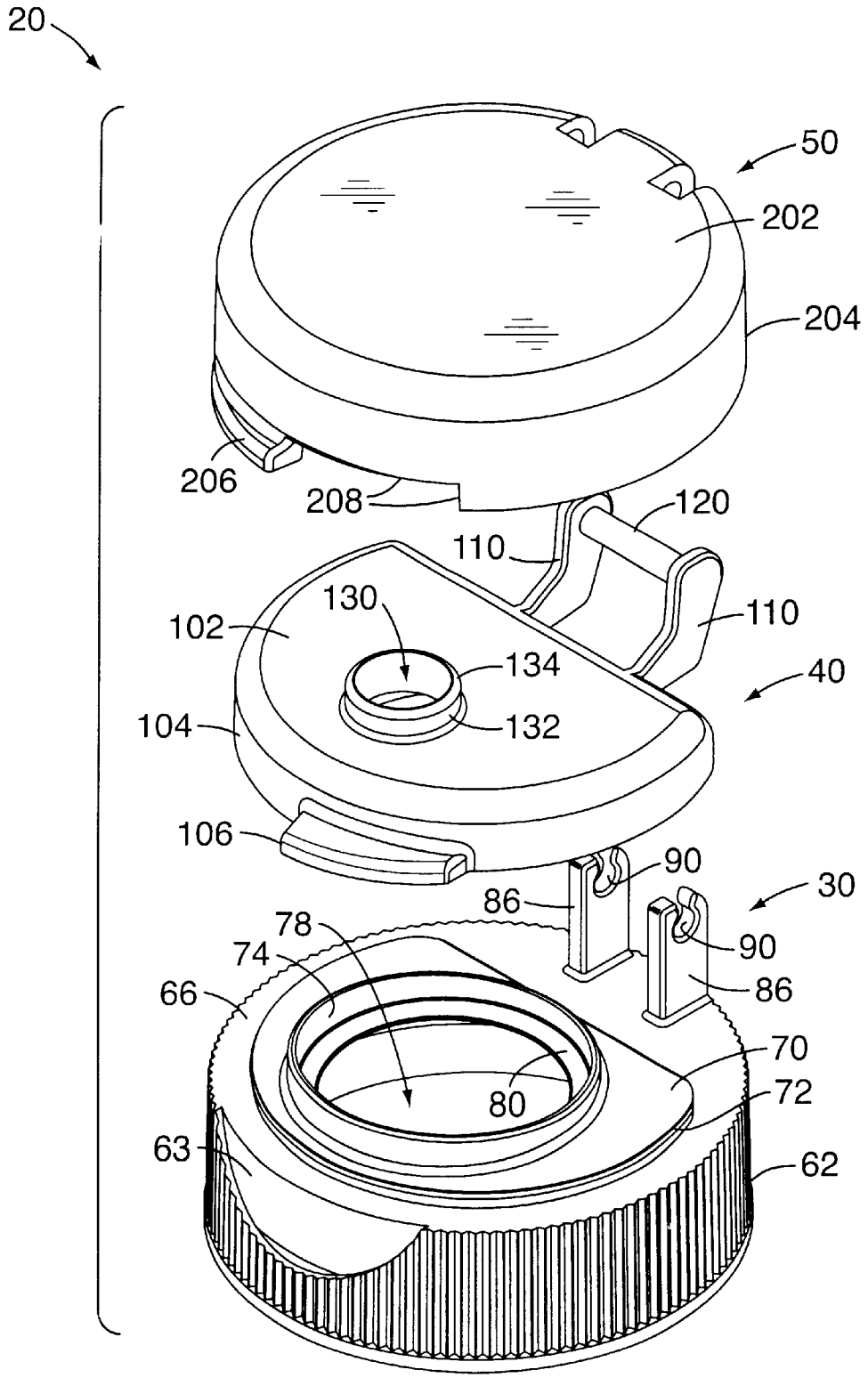
FIG. 3 is an exploded, perspective view of the dispensing structure or closure shown in FIG. 1.

As illustrated in FIGS. 2 and 3, in the preferred embodiment of the dispensing structure 20, the body 30 may be characterized as having or defining a skirt 62 for removably or non-removably receiving the upper end of the container (not illustrated). The skirt 62 interior includes suitable connecting means, such as a conventional thread 64 (FIG. 2) adapted to be threadingly engaged with a mating container thread (not illustrated). The closure body 30 and container could also be attached with either a dual snap-fit bead engagement or a mating bead and groove engagement.

Also, the closure body 30 could be permanently fixed to the container by means of induction melting, ultrasonic melting, gluing, or the like, depending upon the materials used for the closure body 30 and container. As previously mentioned, the closure body could also be formed as a unitary part, or extension, of the container.

The front exterior of the skirt 62 includes a thumb recess 63. Above the recess 63, as illustrated in FIG. 4, the top of the closure body 30 defines a peripheral deck 66. A platform 70 extends upwardly from the deck 66 inwardly of the skirt 62. The sidewall of the platform 70 has a bead 72.

As shown in FIG. 3, a ring or collar 74 extends upwardly from the platform 70. The collar 74 circumscribes, and defines, a first dispensing aperture 78 through the closure body 30 for communication with the container interior when the closure body 30 is mounted on the container. As can be seen in FIGS. 2 and 3, the collar 74 is higher at the front (adjacent the thumb recess 63) than at the rear. However, the collar 74 could be lower at front if desired. On the inside of the collar 74, there is a radially, inwardly extending, annular, flexible sealing flange 80. The sealing flange 80 is adapted to deform for sealingly engaging a portion of the intermediate member 40 when the intermediate member is closed as illustrated in FIG. 2.

At the rear of the closure body deck 66 are a pair of upwardly projecting hinge support posts 86 which each defines an upwardly open, partially cylindrical bearing surface 90 (FIG. 3).

Figure 8:
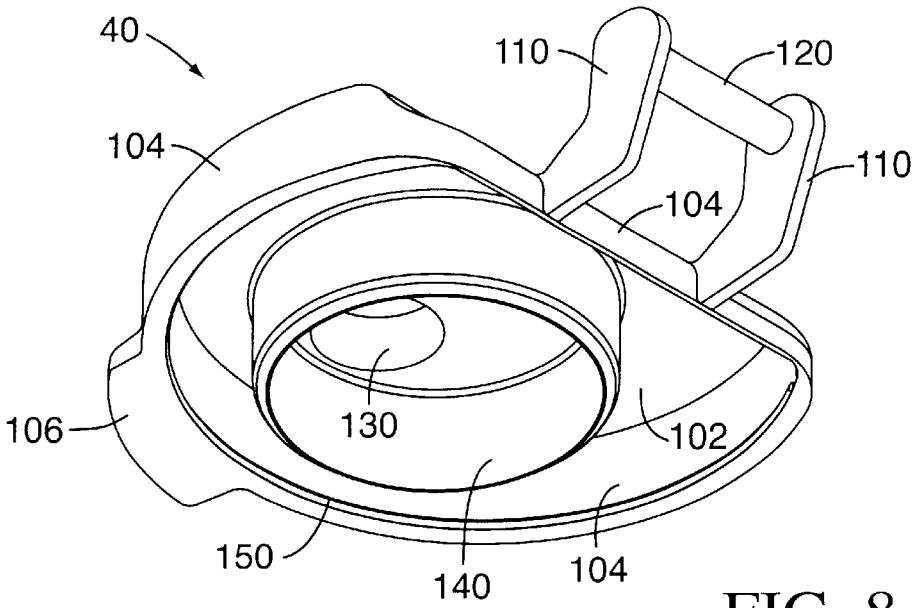
FIG. 8 is a perspective view of the intermediate member from below and behind the intermediate member.

As shown in FIG. 8, the intermediate member 40 has a deck 102 surrounded by a downwardly depending skirt 104. At the front of the skirt 104, there is an outwardly projecting thumb lift or finger lift 106. At the rear of the intermediate member 40 there are a pair of lugs 110 which each projects rearwardly from the intermediate member skirt 104 and which are joined near their distal ends by a generally cylindrical shaft or rod 120 defining a main hinge axis which is coincident with the axis of the cylindrical configuration of the rod 120. The rod 120 is adapted to be received on the bearing surfaces 90 of the closure body posts 86 for rotation thereon. As can be seen in FIG. 5, the intermediate member lugs 110 and the closure body posts 86 are arranged such that the posts 86 are between the lugs 110. If desired, the rod 120 could have a cross-sectional shape other than round, such as, for example, oval, triangular, etc. Such other shapes could be employed to effect a bias or preferred position with respect to the rod.

With reference to FIG. 3, the opening of each closure body post 86 above the bearing surface 90 is somewhat less than the diameter of the bearing surface 90 and somewhat less than the diameter of the intermediate member shaft or rod 120. The portion of each post 86 at the opening to the bearing surface 90 is sufficiently flexibly resilient to accommodate insertion of the shaft or rod 120 in a snap-fit engagement which accommodates rotation of the shaft or rod 120 on each bearing surface 90.

As shown in FIG. 4, the intermediate member deck 102 includes at least one second dispensing aperture 130 which is surrounded by a flange or spout 132 projecting upwardly from the deck 102. The top, peripheral portion of the spout 132 includes a radially outwardly projecting, annular bead 134.

As best illustrated in FIG. 8, the intermediate member 40 includes a downwardly projecting, annular flange 140 for sealingly engaging the sealing flange 80 on the closure body 30 when the intermediate member 40 is in the fully closed position (as illustrated in FIG. 2).

As best illustrated in FIG. 8, the inside arcuate portion of the intermediate member skirt 104 includes a radially inwardly projecting bead 150. As shown in FIG. 2, when the intermediate member 40 is in the fully closed position, the intermediate member skirt bead 150 is in snap-fit engagement beneath the overriding, mating bead 72 on the arcuate sidewall portion of the closure body deck platform 70. This serves to retain the intermediate member 40 in the closed position unless and until it is forcefully disengaged by pushing upwardly on the thumb lift tab 106 (FIG. 4).

Figure 6:
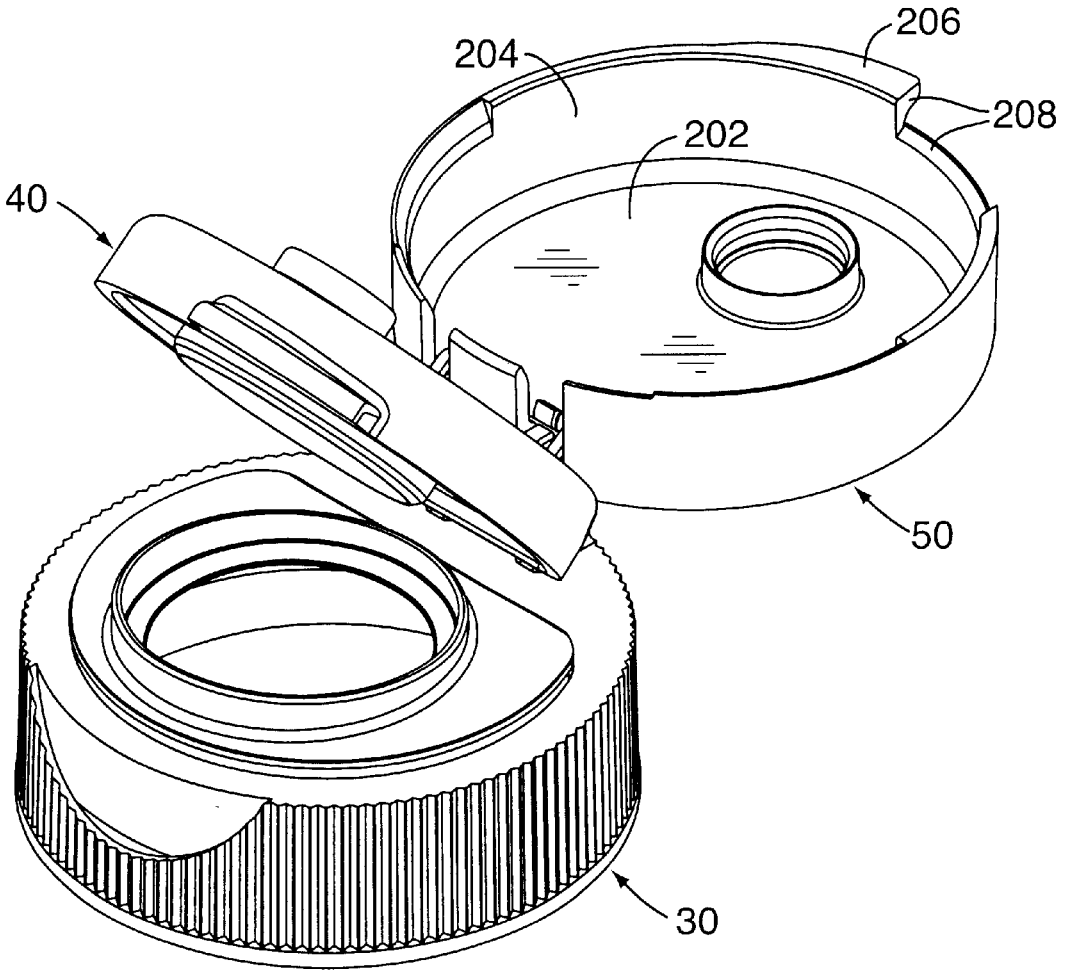
FIG. 6 is a view similar to FIG. 5 from a slightly lower perspective.
Figure 9:
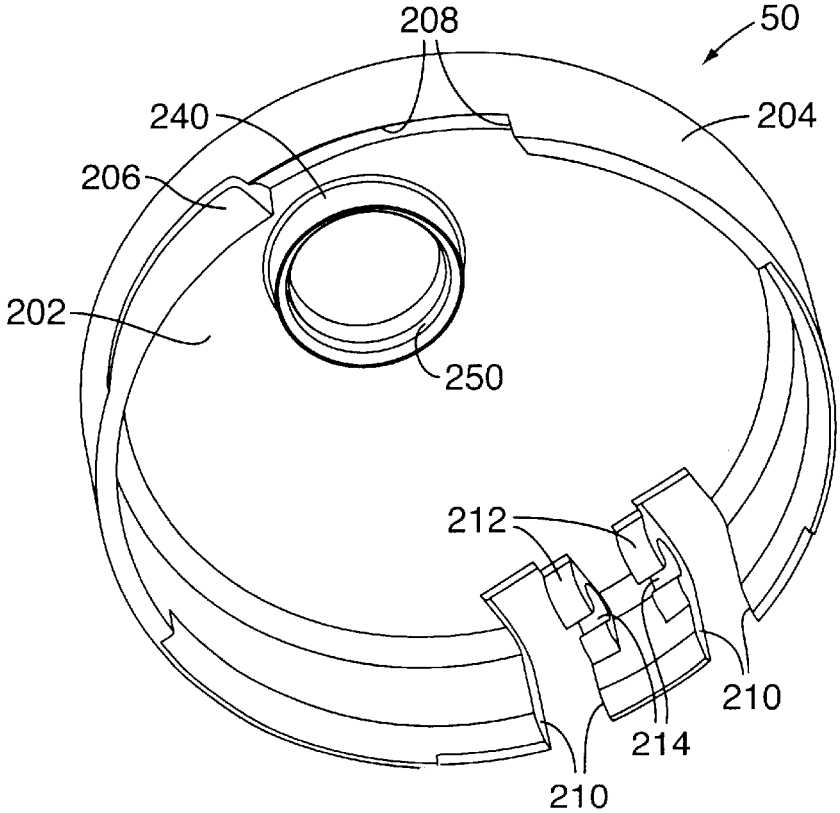
FIG. 9 is a perspective view of the lid from below.

The cover or lid 50 is shown in FIGS. 6 and 9 as including a central portion or deck 202 and a downwardly depending, peripheral skirt 204. Projecting outwardly from a front portion of the skirt 204 is a thumb lift 206. Adjacent the thumb lift 206 is a notch 208 for accommodating the thumb lift 106 of the intermediate member 40 as shown in FIG. 1.

As illustrated in FIG. 9, a rear portion of the lid 50 includes a pair of spaced-apart notches 210. Between the notches 210 are a pair of lugs 212, each lug 212 defines an upwardly open bearing surface 214 for receiving a portion of the rod or shaft 120 of the intermediate member 40. When the lid 50 is mounted so that the intermediate member shaft 120 is received within the lid lug bearing surfaces 214, the lid notches 210 receive the closure body posts 86 and the two intermediate member lugs 110 as can be seen in FIGS. 4 and 5.

As can be seen in FIG. 9, the lid 50 has a sealing flange or collar 240 which projects downwardly from the underside of the lid deck 202. Adjacent the open distal end of the collar 240 there is an inwardly projecting, annular bead 250. When the lid 50 is in the fully closed position as illustrated in FIG. 2, the lid collar 240 is received on the exterior of the intermediate member spout 132, and the lid flange bead 250 is received below the spout bead 134 in a snap-fit engagement to hold the lid 50 closed unless and until the lid 50 is pivoted upwardly by pushing on the thumb lift 206.

The dispensing structure 20 is easily used. A user typically encounters the dispensing structure 20 in an initially closed condition (FIGS. 1 and 2) mounted on a container (not shown). The user may initially lift the lid 50 by applying an upward force with a finger or thumb to the lid lift tab 206. The lid 50 may be rotated to a fully opened position as shown in FIG. 4 to expose the dispensing aperture 130 of the intermediate member 40.

Figure 7:
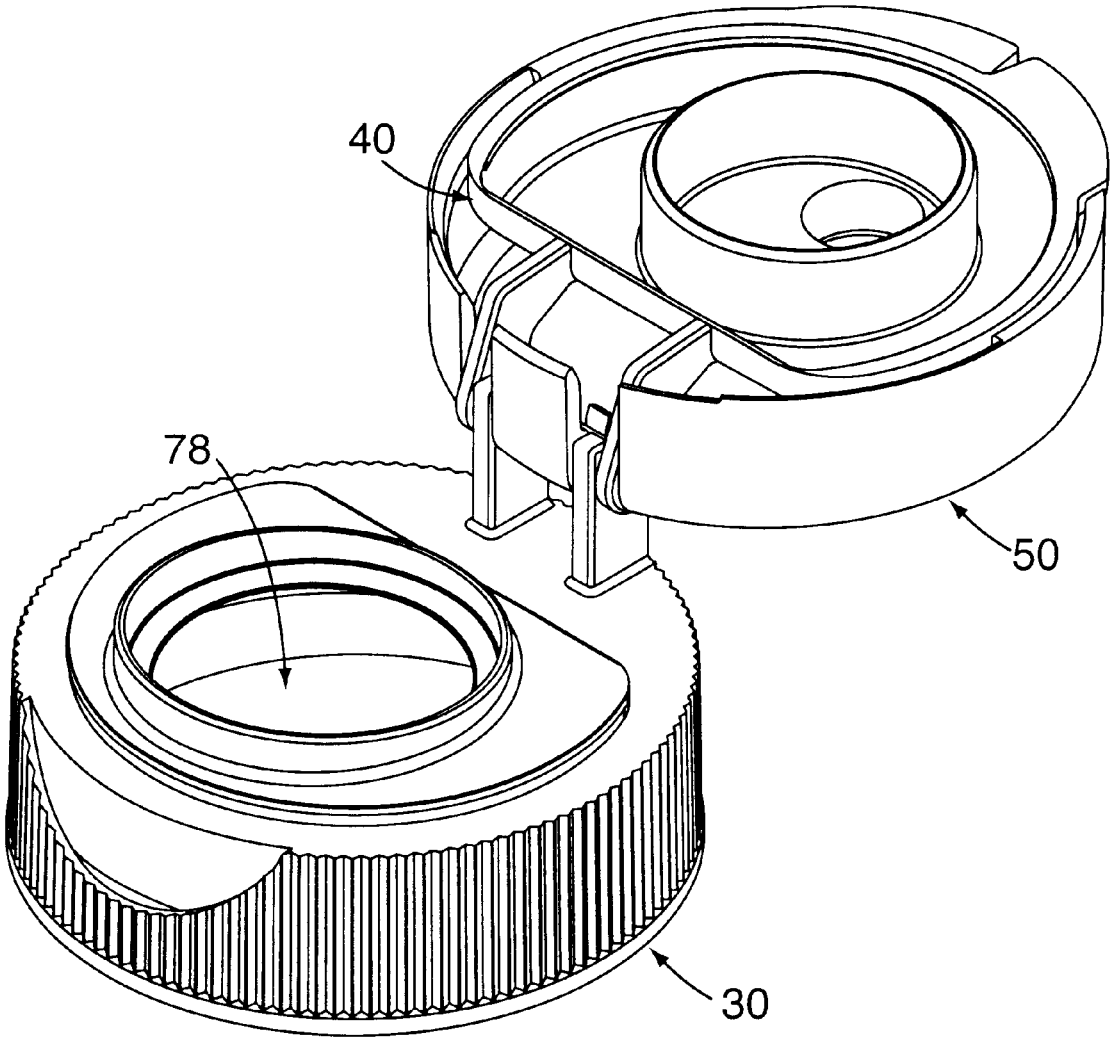
FIG. 7 is a view similar to FIG. 6, but FIG. 7 shows the intermediate member opened fully to an open position and nested within the open lid.

Instead of dispensing product from the container through the dispensing aperture 130, the user may wish to also initially lift the intermediate member 40 with its lift tab 106 to a fully opened position as illustrated in FIG. 7. However, to more efficiently use the system, the user could initially lift both the intermediate member 40 and lid 50 together upwardly from the closed position shown in FIGS. 1 and 2 to an open position shown in FIG. 7. The user could do this merely by lifting upwardly only on the intermediate member lift tab 106.

With reference to FIG. 6, it will be appreciated that the intermediate member 50 fits within, and nests within, the lid 50 in the open position so as to provide a more compact configuration and so as to provide substantial clearance around the closure body dispensing aperture 78.

The closure body dispensing aperture 78 may be relatively large to provide access to the interior of the container with a spoon or other implement or to accommodate pouring of a large stream of product through the dispensing aperture 78.

If it is desired to dispense a smaller amount of product, such as a small diameter discharge stream of product, the intermediate member can be initially left in the closed position (FIG. 4), or returned from the open position (FIG. 7) to the closed position (FIG. 4). When the intermediate member 40 is in the closed position as shown in FIG. 4, the product can be discharged from the container through the intermediate member dispensing aperture 130 which may be substantially smaller than the closure body dispensing aperture 78. When the intermediate member 40 is in the closed position illustrated in FIG. 4, the intermediate member flange 140 (FIG. 2) is sealingly engaged with the closure body flexible sealing flange 80 in the larger dispensing aperture 78. Further, the deck portion 102 of the intermediate member 40 blocks a peripheral portion of the larger, first dispensing aperture 78 which extends peripherally beyond the smaller, second dispensing aperture 130.

When the user is finished dispensing product through the dispensing closure 20, the lid 50 may be returned to the closed position illustrated in FIGS. 1 and 2. If the intermediate member 40 was in an open position with the lid 50, then both the intermediate member 40 and the lid 50 can be returned together to the closed position. In the closed position, the lid 50 is sealingly engaged with the intermediate member 40 to sealingly occlude the second dispensing aperture 130 and thus prevent flow out of the dispensing structure 20.

It is presently contemplated that many applications employing the dispensing structure 20 will be most conveniently realized by molding the dispensing structure 20 from suitable thermoplastic material or materials. In the preferred embodiment illustrated, the body 30, intermediate member 40, and lid 50 could each be molded from a suitable thermoplastic material, such as polypropylene. The body 30, intermediate member 40, and lid 50 may be separately molded from the same material or from a different material. The materials may have the same or different colors.

It will also be appreciated that various retention structures, instead of the one described above, may be provided for releasably retaining the foraminous member 40 in the seated or closed position. Further, suitable interference-fit structures or latch structures, instead of the one described above, may be provided in conventional or non-conventional designs for releasably retaining the lid 50 in the closed position. Such conventional lid-retention structures can include a suitable interference fit or a snap-fit engagement between very small ribs (not illustrated) on the lid and body or a snap-fit engagement between a very small rib on the lid and a mating groove on the body or vice versa (not illustrated).

It will also be appreciated that the dispensing structure 20 can be readily designed to incorporate appropriate tamper-evident features and/or child-resistant features. Such features may be incorporated within the structure of the closure body and lid and/or may include overcap structures or shrink film systems (not illustrated).

When the intermediate member 40 is in an open position nested within the open lid 50 (FIG. 7), the intermediate spout bead 134 is in snap-fit engagement with the lid collar bead 250 to retain the lid 50 and intermediate member 40 together in the nested relationship. This allows the user to more easily control the location of the lid 50 and intermediate member 40, and this allows the user to more easily accommodate dispensing of product from the closure body dispensing aperture 78.

In the embodiment illustrated in FIGS. 1–9, the closure body posts 86 are positioned between the intermediate member lugs 110 (FIG. 4). However, it will be appreciated that in an alternate embodiment, the closure body posts 86 could be on the outside of the intermediate member lugs 110. In such an embodiment, the rod or shaft 120 (FIG. 8) would extend laterally outwardly beyond each lug 110 for being received in the closure body posts 86 on the exterior of the lugs 110.

Further, it will be appreciated that in an alternate embodiment, the rod or shaft 120 may be molded as part of the closure body posts 86, and the intermediate member lugs 110 could be provided with cooperating open bearing surfaces for engaging the shaft 120.

Also, in another alternate embodiment, the rod or shaft 120 could be molded as an extension of the lid lugs 212, and the intermediate member lugs 110 could be provided with open bearing surfaces for engaging such a shaft on the lid.

In another embodiment, the intermediate member 40 and lid 50 could be molded together as a unitary structure connected by a thin portion of material defining a unitary hinge with an integral or unitary shaft (such as the shaft 120 illustrated in FIG. 8) for being received in the bearing surfaces 90 of the closure body posts 86 (FIG. 3).

Alternatively, the intermediate 40 and closure body 30 could be molded together as a unitary structure connected by a thin piece of material defining a hinge with a unitary shaft, such as the shaft 120 (FIG. 8) molded as part of the structure for being received in the lid bearing surfaces 214 (FIG. 9). In each of the above-described last two embodiments, the dispensing closure would be a two-piece closure rather than a three-piece closure as illustrated in FIGS. 1–9. Such a two-piece closure could have the advantage of a more simple assembly process.

It will also be appreciated that the dispensing structure of the present invention need not be provided as a separate closure for a container. The closure body, such as closure body 30, could instead be molded as a unitary part of a container. A container having a peripheral wall forming an end that defines a container opening could be molded with a body portion extending radially inwardly from the container peripheral wall over the container end opening so as to form a unitary part of the container end and so as to define the first dispensing aperture, such as the dispensing aperture 78 illustrated in FIG. 3, that would be smaller than the container end opening.

In the embodiment illustrated in FIGS. 1–9, the dispensing structure is in the form of a closure which can be removably attached to a container by threaded engagement. It will be appreciated that other removable or non-removable attachment systems may be employed as discussed in detail above.

It should be understood that either the body first dispensing aperture 78 or the intermediate member second dispensing aperture 130 could include a pressure-openable valve, such as, for example, any of the slit-type valves disclosed in the U.S. Pat. No. 5,839,614, or modifications of such valves.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing structure for a container that has an opening to the container interior, said dispensing structure comprising:

a body for extending around said container opening, said body defining a first dispensing aperture communicating with said container opening;

an intermediate member defining at least one second dispensing aperture that is smaller than said first dispensing aperture, said intermediate member being pivotable about an axis between (1) a closed position sealingly engaged with said body to locate said second dispensing aperture over said first dispensing aperture and block a peripheral portion of said first dispensing aperture which extends peripherally beyond said second dispensing aperture, and (2) an open position away from said closed position to permit complete access to said first dispensing aperture;

a lid pivotable about said axis between (1) a lid closed position over said second dispensing aperture for sealingly engaging said intermediate member when said intermediate member is in its closed position whereby said second dispensing aperture is sealingly occluded, and (2) an open position away from said lid closed position to permit access to said second dispensing aperture when said intermediate member is in said closed position; said lid including a skirt for being disposed around at least a portion of said intermediate member to receive said intermediate member nested within said lid; and a releasable snap-fit engagement between said lid and said intermediate member to accommodate pivoting of said lid and intermediate member about said axis while nested together.

2. The dispensing structure in accordance with claim 1 in which said dispensing structure is a closure for an end of said container wherein the container end defines said container opening; and said closure includes said body, said intermediate member, and said lid.

3. The dispensing structure in accordance with claim 2 in which said closure is an article that is separate from said container; and said body is removably attachable to said container end over said container opening.

4. The dispensing structure in accordance with claim 2 in which said container includes a peripheral wall forming said end that defines said container opening; and said body extends radially inwardly from said peripheral wall over said container end opening as a unitary part of said container end to define said first dispensing aperture that is smaller than said container end opening.

5. The dispensing structure in accordance with claim 1 in which said body and intermediate member are molded together as a unitary structure joined by a hinge accommodating pivoting of said body and intermediate member about said axis.

6. The dispensing structure in accordance with claim 1 in which said intermediate member and said lid are molded together as a unitary structure joined by a hinge accommodating pivoting of said intermediate member and lid about said axis.

7. The dispensing structure in accordance with claim 1 in which said closure body includes a flexible, resilient, annular flange adjacent said first dispensing aperture;

said intermediate member includes a flange for sealingly engaging said resilient annular flange on said closure body;

said intermediate member has a pair of rearwardly extending lugs and a shaft connected to said lugs for defining said axis;

said body includes a pair of posts each defining an open bearing surface for receiving said shaft;

said lid has a pair of lugs each defining an open bearing surface for receiving said shaft;

said lid includes a thumb lift; and said intermediate member includes a thumb lift.

8. The dispensing structure in accordance with claim 1 in which said lid includes a collar having a snap-fit bead; and said intermediate member second dispensing aperture is circumscribed by a spout having a snap-fit bead for effecting said releasable snap-fit engagement between said lid and said intermediate member to accommodate the reception of said intermediate member in said lid permitting said lid and said intermediate member to be pivoted together in a nested configuration between said closed and open positions.

9. A dispensing structure for a container that has an opening to the container interior, said dispensing structure comprising:

a body for extending around said container opening, said body defining a first dispensing aperture communicating with said container opening;

an intermediate member defining at least one second dispensing aperture that is smaller than said first dispensing aperture, said intermediate member being pivotable about an axis between (1) a closed position sealingly engaged with said body to locate said second dispensing aperture over said first dispensing aperture and block a peripheral portion of said first dispensing aperture which extends peripherally beyond said second dispensing aperture, and (2) an open position away from said closed position to permit complete access to said first dispensing aperture; and a lid pivotable about said axis between (1) a lid closed position over said second dispensing aperture for sealingly engaging said intermediate member when said intermediate member is in its closed position whereby said second dispensing aperture is sealingly occluded, and (2) an open position away from said lid closed position to permit access to said second dispensing aperture when said intermediate member is in said closed position.

10. The dispensing structure in accordance with claim 9 in which said dispensing structure is a closure for an end of said container wherein the container end defines said container opening; and said closure includes said body, said intermediate member, and said lid.

11. The dispensing structure in accordance with claim 10 in which said closure is an article that is separate from said container; and said body is removably attachable to said container end over said container opening.

12. The dispensing structure in accordance with claim 10 in which said container includes a peripheral wall forming said end that defines said container opening; and said body extends radially inwardly from said peripheral wall over said container end opening as a unitary part of said container end to define said first dispensing aperture that is smaller than said container end opening.

13. The dispensing structure in accordance with claim 9 in which each of said body first and second dispensing apertures has a generally circular flow area.

14. The dispensing structure in accordance with claim 9 in which said intermediate member has a partially circular portion and has a lift tab extending outwardly of said body at a location generally diametrically opposite from said hinge.

15. The dispensing structure in accordance with claim 9 in which said body and intermediate member are molded together as a unitary structure joined by a hinge accommodating pivoting of said body and intermediate member about said axis.

16. The dispensing structure in accordance with claim 9 in which said intermediate member and said lid are molded together as a unitary structure joined by a hinge accommodating pivoting of said intermediate member and lid about said axis.

17. The dispensing structure in accordance with claim 9 in which said closure body includes a flexible, resilient, annular flange adjacent said first dispensing aperture; and said intermediate member includes a flange for sealingly engaging said resilient annular flange on said closure body.

18. The dispensing structure in accordance with claim 9 in which said intermediate member has a pair of rearwardly extending lugs and a shaft connected to said lugs for defining said axis;

said body includes a pair of posts each defining an open bearing surface for receiving said shaft; and said lid has a pair of lugs each defining an open bearing surface for receiving said shaft.

19. The dispensing structure in accordance with claim 9 in which said lid includes a thumb lift; and said intermediate member includes a thumb lift.

20. The dispensing structure in accordance with claim 9 in which said lid includes a collar having a snap-fit bead; and said intermediate member second dispensing aperture is circumscribed by a spout having a snap-fit bead for effecting a releasable snap-fit engagement between said lid and said intermediate member to accommodate the reception of said intermediate member in said lid permitting said lid and said intermediate member to be pivoted together in a nested configuration between said closed and open positions.

* * * * *